US007900746B2

(12) United States Patent
Fleming

(10) Patent No.: US 7,900,746 B2
(45) Date of Patent: Mar. 8, 2011

(54) LIFT CADDY

(76) Inventor: Robert J. Fleming, Oklahoma City, OK (US)

( * ) Notice: Subject to any disclaimer, the term of this patent is extended or adjusted under 35 U.S.C. 154(b) by 922 days.

(21) Appl. No.: 11/519,712

(22) Filed: Sep. 12, 2006

(65) Prior Publication Data

US 2007/0056920 A1 Mar. 15, 2007

Related U.S. Application Data

(60) Provisional application No. 60/717,162, filed on Sep. 15, 2005.

(51) Int. Cl.
*E04G 5/00* (2006.01)

(52) U.S. Cl. ..... 182/129

(58) Field of Classification Search ..... 182/129
See application file for complete search history.

(56) References Cited

U.S. PATENT DOCUMENTS

| | | | | | |
|---|---|---|---|---|---|
| 4,635,835 | A * | 1/1987 | Cole | 224/504 |
| 5,044,467 | A * | 9/1991 | Heiden | 182/130 |
| 5,263,578 | A * | 11/1993 | Narvey | 206/232 |
| 5,308,012 | A * | 5/1994 | Fuller | 242/557 |
| 5,472,164 | A * | 12/1995 | Contee, Jr. | 248/214 |
| D366,903 | S * | 2/1996 | Baggott | D19/78 |
| 6,095,057 | A * | 8/2000 | Corban | 108/42 |
| 7,063,187 | B1 * | 6/2006 | Lavigne | 182/129 |
| 7,461,822 | B2 * | 12/2008 | Edwards | 248/214 |
| 2005/0127254 | A1 * | 6/2005 | Scott et al. | 248/188 |
| 2006/0021985 | A1 * | 2/2006 | Jasper | 220/475 |

* cited by examiner

*Primary Examiner* — Alvin C Chin-Shue
(74) *Attorney, Agent, or Firm* — Dunlap Codding, P.C.

(57) ABSTRACT

A lift caddy for a personnel lift having at least one horizontal member, an engaging surface, and a work platform disposed below the horizontal member in spaced apart vertical relation. The lift caddy includes a container, a mounting hook extending from the container, and a pin insertable through an aperture in the upper portion of the mounting hook to limit horizontal travel of the retaining hook relative to the horizontal member when the mounting hook is positioned on the horizontal member. The container is sized so that at least a portion of the exterior surface rests against the engaging surface of the personnel lift to support the container in a substantially vertical orientation when the mounting hook is positioned on the horizontal member.

27 Claims, 6 Drawing Sheets

LIFT CADDY

CROSS REFERENCE TO RELATED APPLICATIONS

This application claims benefit of U.S. Provisional Application No. 60/717,162, filed Sep. 15, 2005, which is incorporated herein by reference in its entirety.

BACKGROUND OF THE INVENTION

1. Field of the Invention

The present invention relates generally to a tool caddy, and more particularly, but not by way of limitation, to a caddy attachable to a personnel lift or aerial work platform for storing and carrying various tools and materials, such as ropes, cables, hoses, light bulbs, drills, hammers, power cables, telecommunications wire, and the like.

2. Brief Description of the Related Art

With the demand for performing myriad tasks in an elevated work environment comes the need to have ready access to a wide variety of tools and materials in such an environment. Currently, due to restrictions such as maneuverability and overall size, aerial work platforms are not large enough nor have the means to carry a technician and all the tools and materials needed to complete multiple or even lengthy tasks. Additionally, the weight and/or configuration of many tools make them impossible to carry on one's person. Finally, restrictions such as time, power, and cost make it infeasible to raise and lower a work platform during the course of a job or to have additional workers positioned below the platform in order to assist by handing materials and tools to the platform worker.

To this end, a need exists for a caddy that has the ability to assist a worker in an aerial work environment and house a diverse and numerous assortment of tools and materials. It is to such a caddy that the present invention is directed.

DETAILED DESCRIPTION OF THE INVENTION

Figure 1:
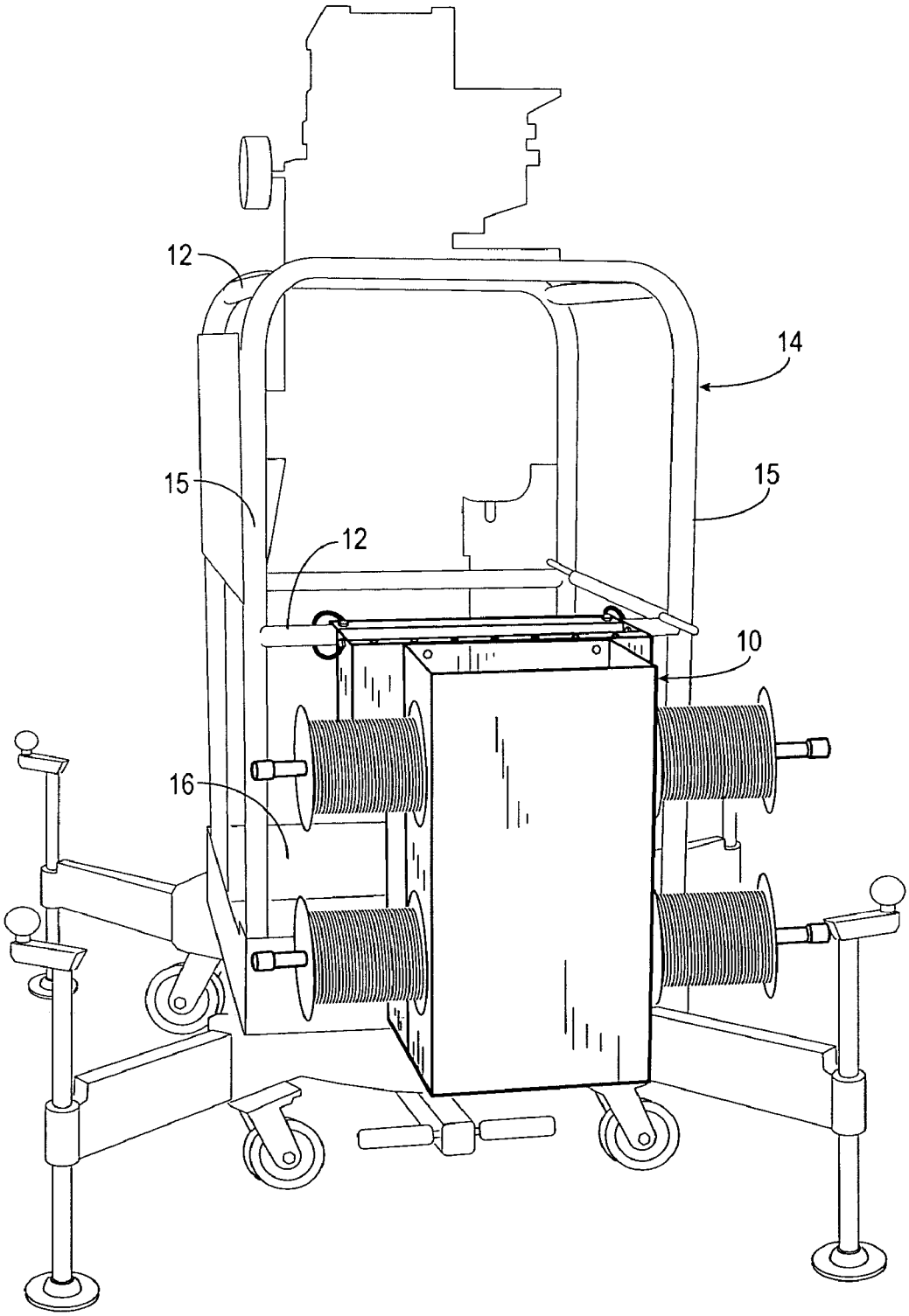
FIG. 1 is a perspective view of a caddy constructed in accordance with the present invention, shown attached to a personnel lift.

Referring now to the drawings, and in particular to FIG. 1, shown therein and designated by a reference numeral 10 is a caddy constructed in accordance with the present invention for facilitating work in elevated environments. More particularly, the caddy 10 is shown mounted to a horizontal member

12 of a personnel lift 14. The personnel lift 14 is a conventional lift, such as sold by Genie Industries, Inc. and may be a vertical telescoping lift, scissor lift, articulating boom lift, telescoping boom lift, or any other lift having a plurality of horizontal members 12 and a plurality of vertical members 15 cooperating to define the vertices of a box-shaped work area having a bottom area defined by a work platform 16. The caddy 10 can be produced in various sizes and used with a variety of different lifts. The caddy 10 may be constructed from any suitable rigid material, such as sheet metal, plastic, composite, or the like.

Figure 2:
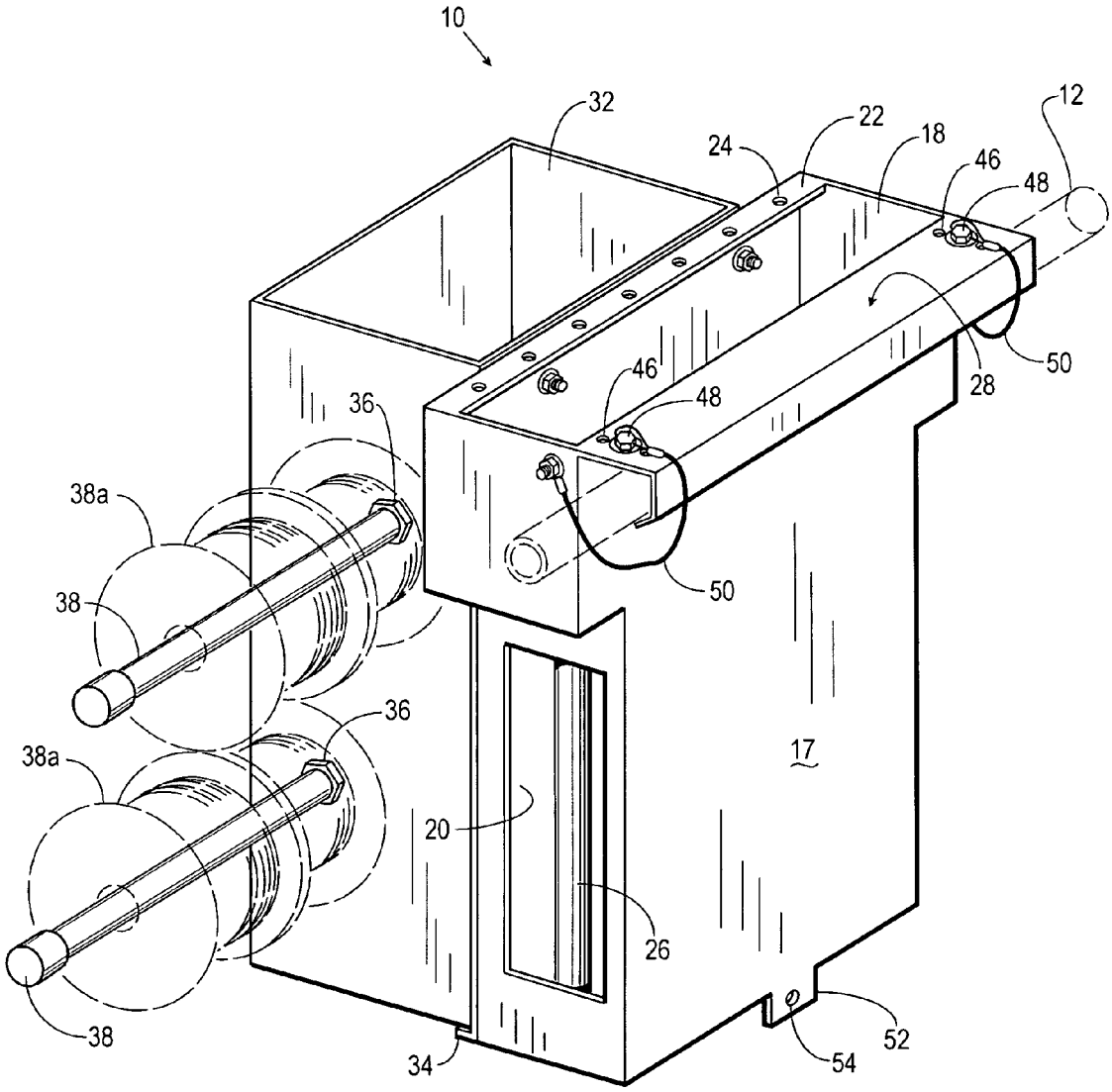
FIG. 2 is an enlarged perspective view of the caddy constructed in accordance with the present invention, shown attached to the frame of a personnel lift.

Referring now to FIG. 2, the caddy 10 is preferably provided with a container 17 for storing and carrying various tools and materials, such as ropes, cables, hoses, light bulbs, drills, hammers, power cables, telecommunications wire, and the like. The preferred embodiment is provided with a box-like container 17 having an upper tray portion 18 and a lower storage portion 20. The upper tray portion 18 preferably has a lip 22, with a plurality of holes 24 of various sizes for storing tools such as screwdrivers, wrenches, pliers, and the like.

The container 17 may also be provided with one or more passages 26 extending vertically through the container. The passage 26 is preferably constructed of a length of pipe extending through the bottom of the container 17, through the lower storage portion 20, into to the upper tray portion 18 to provide a continuous opening through the container 17. The passage 26 may also be defined by one or more rings, holes cut through one or more surfaces of the container 17, or the like. The passage 26 provides a guide for hoses, tubes, wires, canopies, and the like that need to be controlled and easily accessed from the lift. For example, a pressure washer could be positioned at ground level with the hose threaded through the passage 26 prior to raising the lift. The sprayer would then be attached to the end of the hose above the passage 26 to prevent the hose from falling. When the lift is in the raised position, the passage 26 provides a lateral constraint to restrict excess motion of the hose which could reduce the stability of the lift 14. In other embodiments, the caddy 10 may be provided with a variety of containers 17, such as racks, shelves, trays, spools, hooks, hangars, or any other suitable means for attaching desirable tools and materials to the caddy.

The caddy 10 is provided with a mounting hook 28 for attaching the caddy 10 to a horizontal member 12 of the lift 14. The mounting hook 28 hooks over the horizontal member to suspend the caddy as shown. Thus, the caddy 10 is vertically supported by the mounting hook 28 and is horizontally supported by the exterior surface of the container 17 which rests against an engaging surface of the lift 14, generally either a lower horizontal member 12 or an outer surface around the perimeter of the work platform 16 (FIG. 1). The length of the mounting hook 28 preferably extends the full width of the caddy 10, but may also be provided as a shorter segment or in one or more discrete locations along the width of the caddy 10.

The preferred embodiment of the caddy 10 is further provided with a pin 48 connected to each side of the caddy 10 by a cord 50. The pin 48 may be constructed of any durable material and is preferably threaded. Similarly, the cord 50 may be constructed of any durable material such as steel, plastic, aluminum, or the like, and may be a single strand, a cable, a chain, or the like.

The mounting hook 28 is sized so as to be compatible with horizontal members 12 of different sizes and shapes, such as round and square. The caddy 10 may be secured to the lift by hooking the mounting hook 28 over the horizontal member 12. Preferably, the caddy 10 is secured to the rail so that the container 17 is oriented substantially vertically. As such, the mounting hook 28 may be secured to the rail by selectively inserting pins 48 through the holes 46 of the upper portion 40 with the horizontal member positioned adjacent to the side portion 42 of the mounting hook 28. In addition, the cord 50 is preferably sized so that it may be wrapped around at least a portion of the horizontal member prior to inserting the pins 48 into the holes 46. The lower end of the caddy 10 is optionally provided with an additional tab 52 having a hole 54 therethrough. The hole 54 may be used to further secure the caddy 10 to the engaging surface of the lift 14 with any suitable fastener such as a screw, rivet, cord, magnet, or the like.

The caddy 10 may optionally be provided with a secondary container 32 attached to the container 17. The secondary container 32 is preferably attached to the container 17 with nuts and bolts, although any suitable fastening means may be used, such as: screws, rivets, welds, tabs, welds, adhesives, and the like. Additionally, the container 17 is preferably provided with a flange 34 to help support the secondary container 32. As shown, the secondary container 32 may be constructed as a simple open box. The secondary container 32 may also be provided with nipples 36, which are adapted to selectively receive accessories 38 such as, for example, pipes or other axles for attaching spools of wire 38*a* and the like. The nipples 36 may be mounted to the interior or exterior of the container 17. When the nipples 36 are mounted internally, the holes for receiving the accessories preferably extend through the walls of the container 17. The nipples 36 are preferably offset to allow easy rotation of spools as wire is pulled off, for example. The nipples 36 may be threaded or smooth and may also receive hooks, pins, or other suitable fasteners for attaching additional racks and materials. The secondary container 32 is not limited to the preferred box shape and may also comprise racks, shelves, trays, spools, hooks, hangars, or any other suitable means for attaching desirable tools and materials to the caddy.

Figure 3:
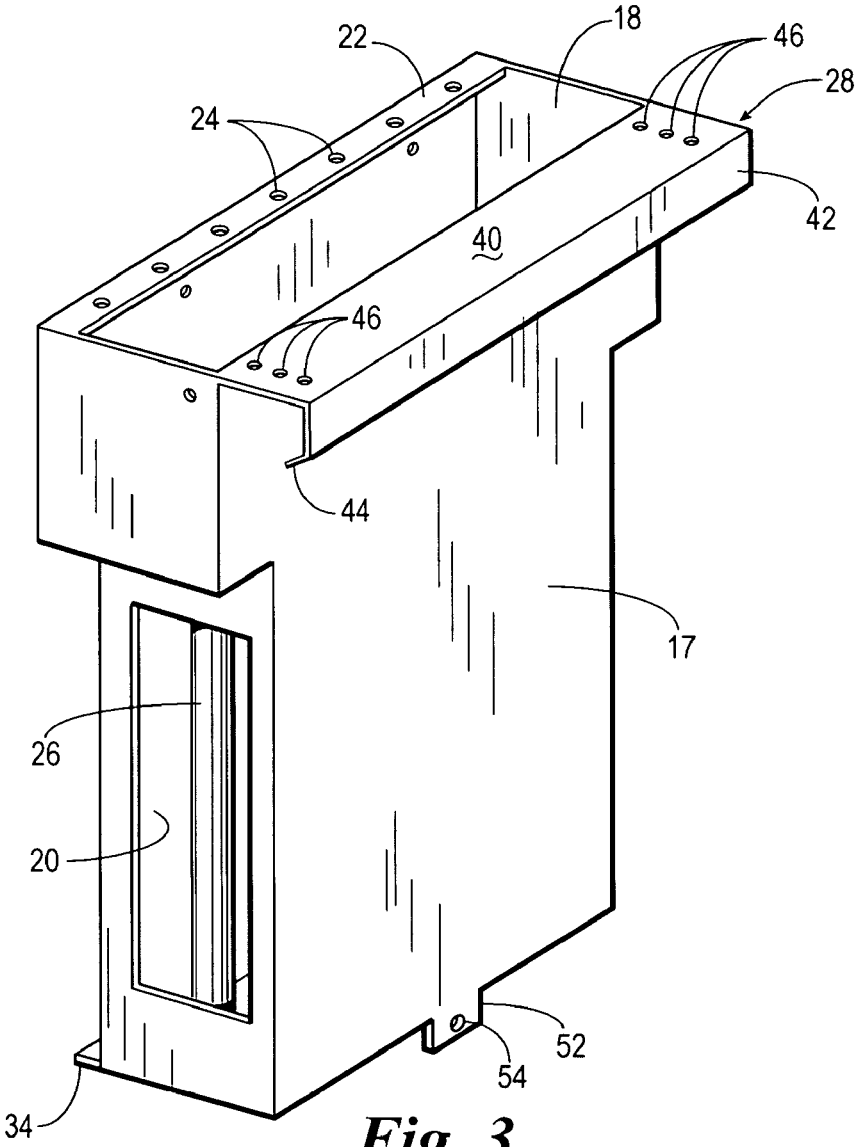
FIG. 3 is a perspective view of a caddy and a mounting hook of the caddy of FIG. 2.

Referring now to FIG. 3, the container 17 and mounting hook 28 are shown in isolation without the secondary container 32 (FIGS. 2 and 4) or the lift 14 (FIG. 1). The mounting hook 28 has a substantially hook-like configuration and preferably includes an upper portion 40, a side portion 42, and a lip portion 44. The upper portion 40 is preferably provided with a plurality of holes 46 formed at each side of the caddy 10 along a line perpendicular to the exterior surface of the container 17.

Figure 4:
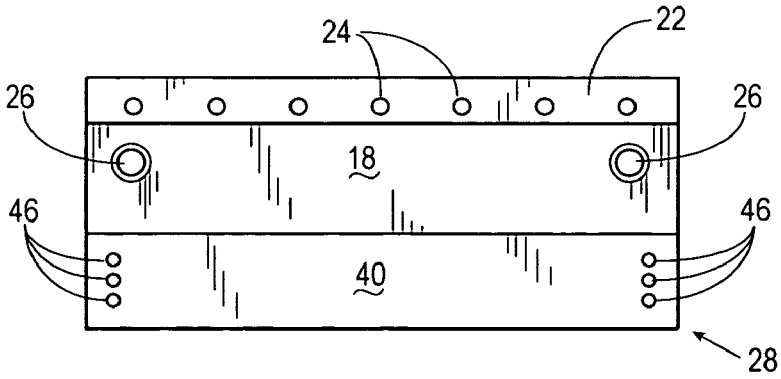
FIG. 4 is a top view of the caddy and mounting hook of the caddy of FIG. 3.

Referring now to FIG. 4, a top view of the container 17 and mounting hook 28 is shown. As described above, the preferred embodiment of the container 17 has a an upper tray portion 18. The upper tray portion 18 is preferably provided with a lip 22 having a plurality of holes 24 of various sizes for holding tools such as screwdrivers, wrenches, pliers, and the like. As described above and more clearly shown here, the passages 26 extend through the container 17 into the upper tray portion 18 to provide an opening for hoses, wires, cords, and the like. As also described above, the caddy 10 is provided with a mounting hook 28 preferably having an upper portion 40 with a plurality of holes 46.

Figure 5:
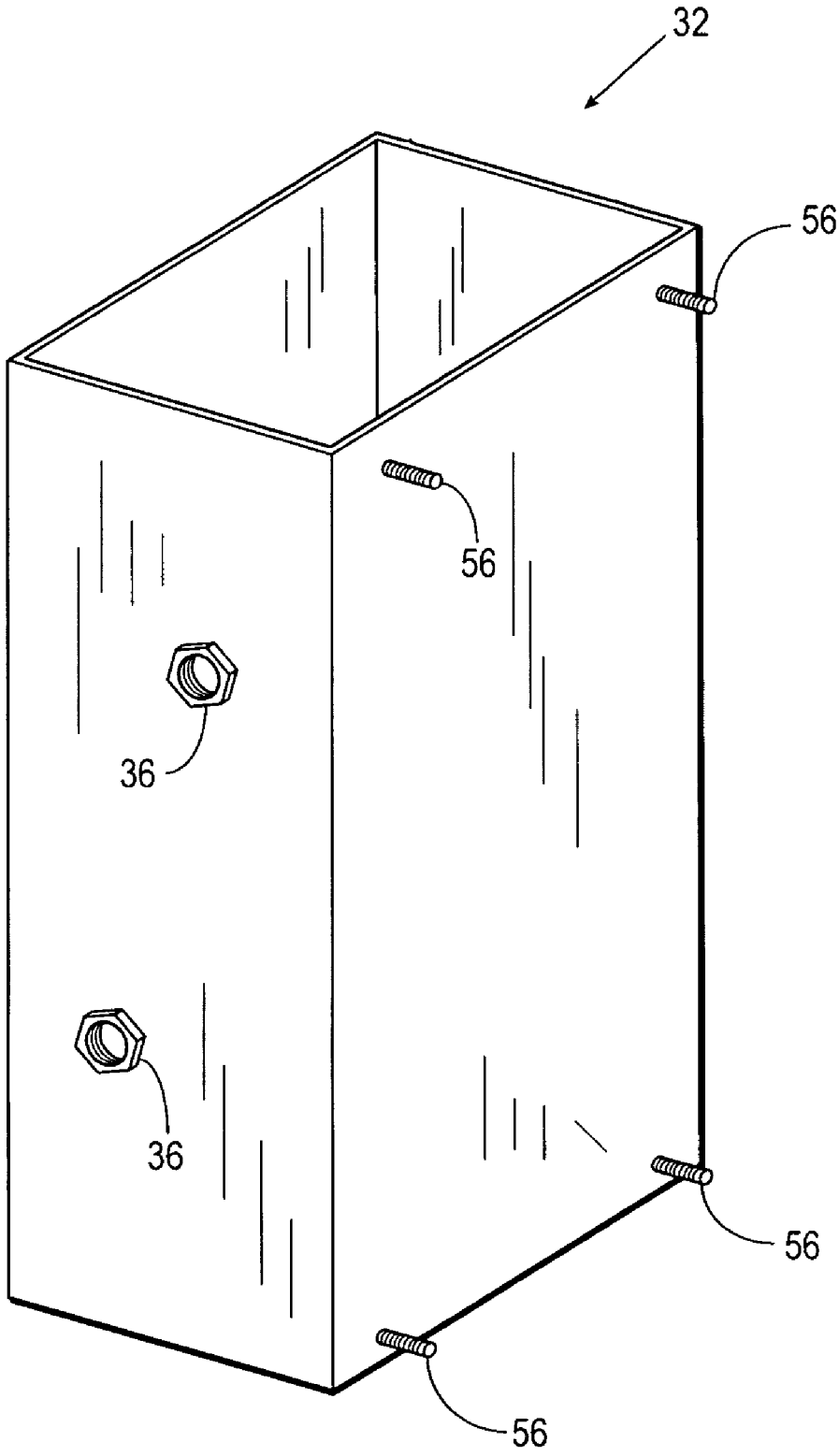
FIG. 5 is a perspective view of a secondary container of the caddy of FIG. 2.

Referring now to FIG. 5 the secondary container 32 of FIG. 2 is shown in isolation. As described above, the secondary container 32 may be a simple open box. In the preferred embodiment, the secondary container 32 is attached to the container 17 (FIG. 2) with four bolts 56 and wing nuts (not shown). In the preferred embodiment, the secondary container 32 provides an additional storage box and is uniquely adaptable to carry one or more spools of wire via nipples 36. The secondary container 32 is preferably provided with a total of four nipples 36, two on each side of the secondary container 32 located in corresponding mirror opposite positions. Thus, pipes or other axles may be inserted into the nipples 36 to support spools of wire, for example, either outside or inside of the secondary container 32.

Figure 6:
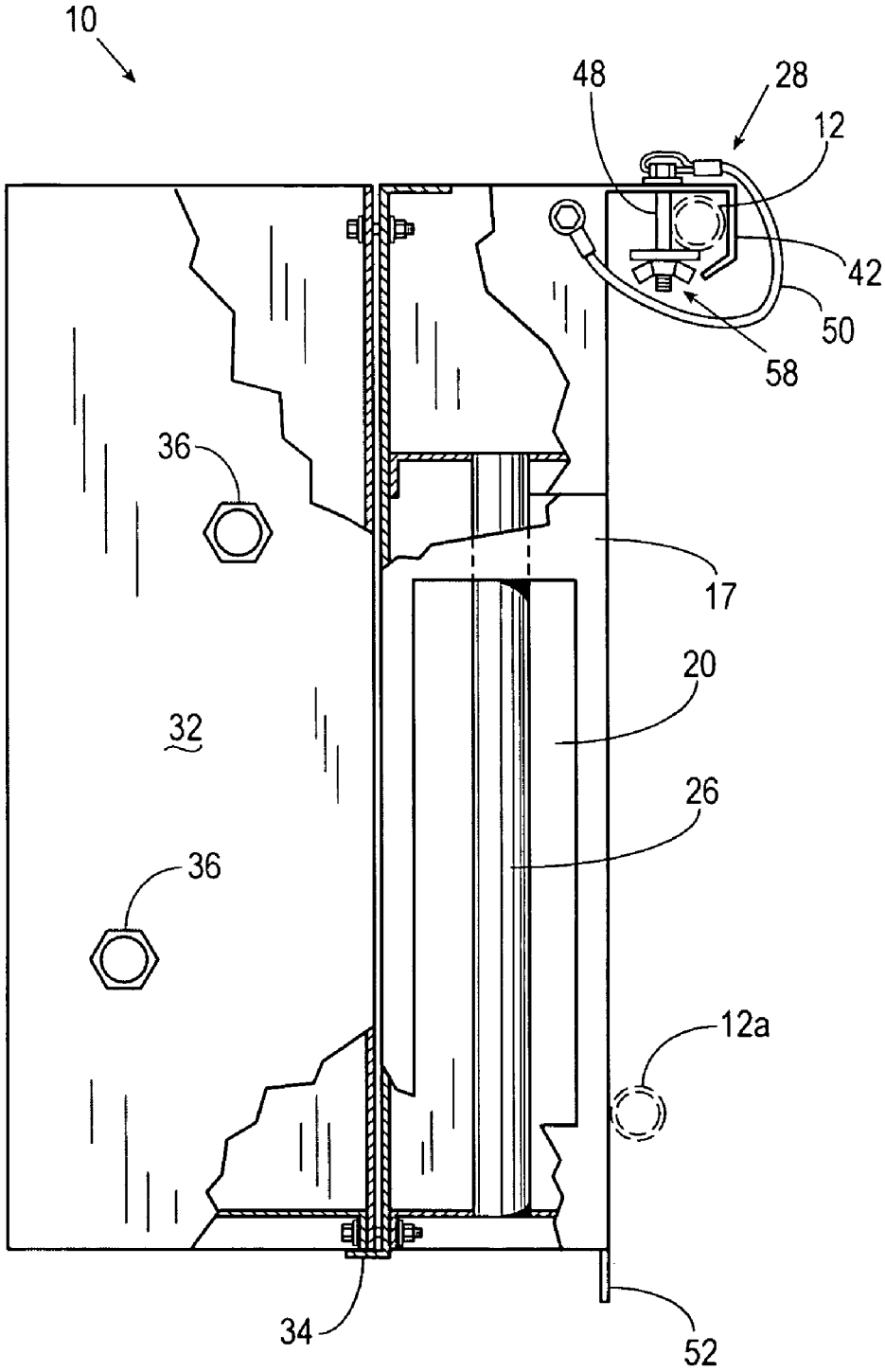
FIG. 6 is a partially cutaway, side elevational view of the caddy of FIG. 2, shown attached and secured to the frame of the personnel lift.

Referring now to FIG. 6, the caddy 10 is shown installed on the horizontal member 12 of the lift 14. As best shown here, one of the unique aspects of the mounting hook 28 is that it is well suited to hold the container 17 in a substantially vertical orientation when suspended from a horizontal member 12 that is offset from the engaging surface, for example a lower horizontal member 12*a*. In the installed configuration of such an embodiment, the mounting hook 28 is hooked over the horizontal member 12 and the cord 50 is wrapped around at least a portion of the horizontal member 12. The pin 48 is inserted into the one of the holes 46 that is most closely situated to the edge of the horizontal member 12. Thus, the horizontal member 12 is fit as snugly as possible between the inserted pin 48 and the side portion 42 of the mounting hook 28. The pin 48 thereby restricts the horizontal travel of the mounting hook 28 relative to the horizontal member 12. The pin 48 is held in place by a pin retainer 58 (FIG. 7*a*-7*d*) which contacts at least a portion of the horizontal member to restrict the vertical travel of the mounting hook 28 relative to the horizontal member 12.

Referring now to FIGS. 7*a*-7*d*, cutaway views of the mounting hook 28 and exterior surface of the container 17 are shown with a variety of sizes, shapes, and offsets of horizontal members 12 showing the diversity of applications for which the present invention is suited. The cord 50 is omitted from FIGS. 7*a*-7*d* for clarity, but is preferably included for additional strength and safety when connecting the caddy 10 to the lift 14.

Figure 7A:
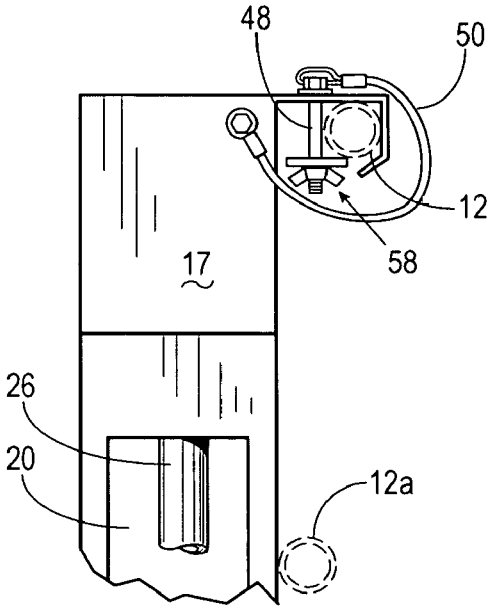
FIGS. 7*a*-7*d* are fragmented, side elevational views showing the mounting hook attached to lift frames of different sizes, shapes, and offsets.

More specifically, FIG. 7*a* depicts the mounting hook 28 and exterior surface of the container 17 of the caddy 10 mounted on a lift with relatively large horizontal members 12 and 12*a* of circular cross-section. As shown, the mounting hook 28 is hooked over horizontal member 12 which is offset from horizontal member 12*a*. The size of the mounting hook 28 allows the container 17 to be suspended in a substantially vertical orientation despite the offset between the horizontal members 12 and 12*a*. The horizontal member 12 is positioned adjacent to the side portion 42 and the pin 48 is inserted through the third of the holes 46 so as to allow the pin 48 to clear the horizontal member 12 as closely as possible. The pin retainer 58 is then threaded onto the pin 48 and tightened to securely restrict the vertical travel of the mounting hook 28 relative to the horizontal member 12.

In the preferred embodiment, the pin retainer 58 is a wing nut and flat washer. However, the pin retainer 58 may also be a pin, integral springs which expand after insertion, notched retainers, or any other suitable retaining mechanism. The pin retainer 58 may also be provided as an elongated member with one or more wings or flanges, the member extending between both pins and secured to the pins with wing nuts or the like.

Figure 7B:
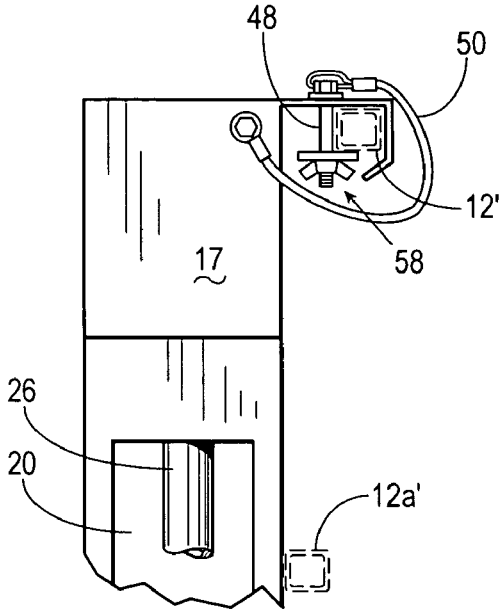

FIG. 7*b* depicts the mounting hook 28 and exterior surface of the container 17 of the caddy 10 mounted on a lift with medium-sized horizontal members 12' and 12*a*' of rectangular cross-section. As shown, the mounting hook 28 is hooked over horizontal member 12' which is offset from horizontal member 12*a*'. The size of the mounting hook 28 allows the container 17 to be suspended in a substantially vertical orientation despite the offset. The horizontal member 12' is positioned adjacent to the side portion 42 and the pin 48 is inserted through the second of the holes 46 so as to allow the pin 48 to clear the horizontal member 12' as closely as possible. The pin retainer 58 is then threaded onto the pin 48 and tightened to securely restrict the vertical travel of the mounting hook 28 relative to the horizontal member 12'.

Figure 7C:
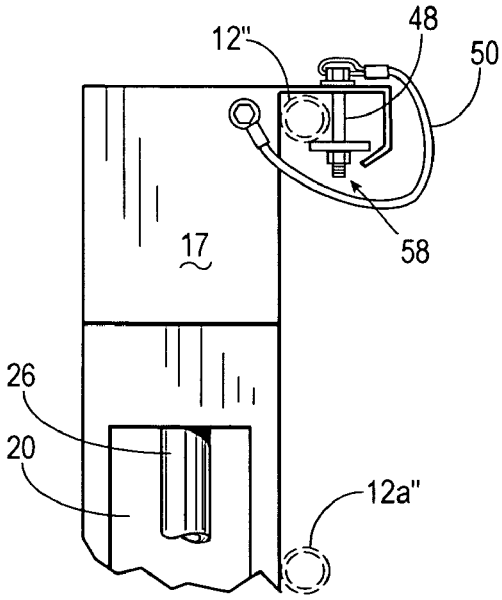

FIG. 7*c* depicts the mounting hook 28 and exterior surface of the container 17 of the caddy 10 mounted on a lift with relatively small diameter horizontal members 12" and 12*a*" of circular cross-section. As shown, the mounting hook 28 is hooked over horizontal member 12" which is vertically aligned with the horizontal member 12*a*". The size of the mounting hook 28 allows the container 17 to be suspended in a substantially vertical orientation from the aligned horizontal member 12" as well as from an offset horizontal member 12, as in FIG. 7*a*. The horizontal member 12" is positioned adjacent to the exterior surface of the container 17 and the pin 48 is inserted through the third of the holes 46 so as to allow the pin 48 to clear the horizontal member 12" as closely as possible. The pin retainer 58 is then threaded onto the pin 48 and tightened to securely restrict the vertical travel of the mounting hook 28 relative to the horizontal member 12".

Figure 7D:
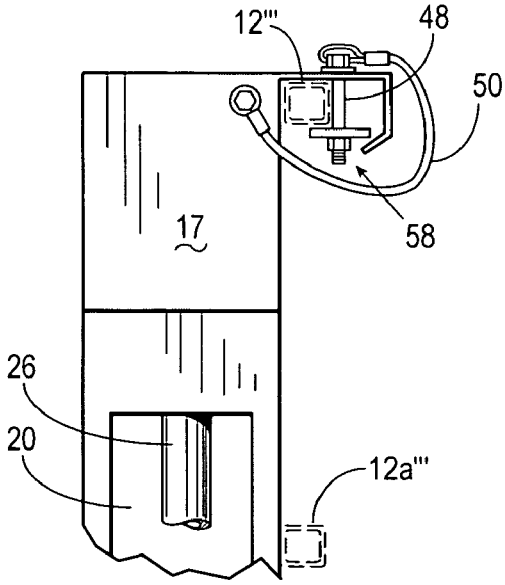

FIG. 7*d* depicts the mounting hook 28 and exterior surface of the container 17 of the caddy 10 mounted on a lift with relatively small horizontal members 12'" and 12*a*'" of rectangular cross-section. As shown, the mounting hook 28 is hooked over horizontal member 12'" which is aligned above horizontal member 12*a*'". The size of the mounting hook 28 allows the container 17 to be suspended in a substantially vertical orientation from the aligned horizontal member 12'" as well as from an offset horizontal member 12, as in FIG. 7*a*. The horizontal member 12'" is positioned adjacent to the exterior surface of the container 17 and the pin 48 is inserted through the third of the holes 46 so as to allow the pin 48 to clear the horizontal member 12'" as closely as possible. The pin retainer 58 is then threaded onto the pin 48 and tightened to securely restrict the vertical travel of the mounting hook 28 relative to the horizontal member 12'".

The present invention alleviates the above noted shortcomings of personnel lifts 14 by having the ability to attach to a lift to house a wide variety of tools and materials. The present invention, therefore, allows a worker to perform the required tasks without the aid of additional workers or the need to raise and lower the platform multiple times to retrieve or return tools and materials. Additionally, the current invention provides a tremendous increase in safety because the worker is no longer compelled to work off the floor of the platform. Therefore, the worker is able to use the entire surface area of the platform for footing and balance. It will be further appreciated that the caddy 10 of the present invention may also be used on other support structures, such as a corral railing, a scaffolding, or the like.

From the above description it is clear that the present invention is well adapted to carry out the objects and to attain the advantages mentioned herein as well as those inherent in the invention. While presently preferred embodiments of the invention have been described for purposes of this disclosure, it will be understood that numerous changes may be made which will readily suggest themselves to those skilled in the art and which are accomplished within the spirit of the invention disclosed.

What is claimed is:

1. A lift caddy for a personnel lift, the personnel lift having at least one horizontal member, an engaging surface, and a work platform disposed below the horizontal member in spaced apart vertical relation, the lift caddy comprising:

a box-like container having an open upper end, a closed lower end, an exterior surface, and a horizontal panel positioned between the open upper end and the closed lower end so as to define a tray portion between the open upper end and the horizontal panel and a storage portion between the horizontal panel and the closed lower end, the container further having at least one tubular member extending from the closed lower end to the horizontal panel to define a passage extending through the closed lower end, the storage portion, and the horizontal panel;

a mounting hook fixed to and extending from the container, the mounting hook having an upper portion, a side portion, and a lip portion, the upper portion substantially perpendicular to the exterior surface and extending therefrom, the upper portion having one or more apertures formed therethrough, the side portion substantially perpendicular to the upper portion and extending downward therefrom, and the lip portion extending toward the exterior surface; and, a pin insertable through the aperture in the upper portion of the mounting hook to limit horizontal travel of the mounting hook relative to the horizontal member when the mounting hook is positioned on the horizontal member, wherein the container is sized so that at least a portion of the exterior surface rests against the engaging surface of the personnel lift to support the container in a substantially vertical orientation when the mounting hook is positioned on the horizontal member.

2. The lift caddy of claim 1 wherein the mounting hook has a fixed width sufficient to permit substantially vertical orientation of the container when the container is suspended from the horizontal member and the horizontal member is offset horizontally from the engaging surface of the personnel lift.

3. The lift caddy of claim 1, wherein the upper portion of the mounting hook further comprises a plurality of apertures so the pin can be selectively inserted to adjust the position of the pin relative to the horizontal member.

4. The lift caddy of claim 1, further comprising a cord having a first end and a second end, the first end connected to the pin and the second end connected to the container.

5. The lift caddy of claim 4, wherein the cord is sized to be wrapped around at least a portion of the horizontal member when the pin is inserted into the aperture so as to further secure the mounting hook relative to the horizontal member.

6. The lift caddy of claim 1, further comprising a pin retainer attached to the pin to limit the vertical travel of the mounting hook relative to the horizontal member.

7. The lift caddy of claim 6, wherein the pin is threaded.

8. The lift caddy of claim 7, wherein the pin retainer is a threaded nut.

9. The lift caddy of claim 6, wherein the pin retainer is expandable after the pin is inserted into the aperture.

10. The lift caddy of claim 1, wherein the container further comprises a pair of tubular members extending from the closed lower end to the horizontal panel to define a pair of passages extending through the closed lower end, the storage portion, and the horizontal panel.

11. The lift caddy of claim 1, wherein two opposing sides of the container are open to the storage portion pair of tubular members extending from the closed lower end to the horizontal panel to define a pair of passages extending through the closed lower end, the storage portion, and the horizontal panel.

12. The lift caddy of claim 1, further comprising a second box-like container attached to the container.

13. The lift caddy of claim 12, wherein the second container further comprises at least two coplanar nipples adapted to selectively receive accessories, the nipples being offset horizontally and vertically.

14. A lift caddy in combination with a personnel lift, the personnel lift having at least one horizontal member, an engaging surface, and a work platform disposed below the horizontal member in spaced apart vertical relation, the lift caddy comprising:

a box-like container having an open upper end, a closed lower end, an exterior surface, and a horizontal panel positioned between the open upper end and the closed lower end so as to define a tray portion between the open upper end and the horizontal panel and a storage portion between the horizontal panel and the closed lower end, the container further having at least one tubular member extending from the closed lower end to the horizontal panel to define a passage extending through the closed lower end, the storage portion, and the horizontal panel;

a mounting hook fixed to and extending from the container, the mounting hook having an upper portion, a side portion, and a lip portion, the upper portion substantially perpendicular to the exterior surface and extending therefrom, the upper portion having one or more apertures formed therethrough, the side portion substantially perpendicular to the upper portion and extending downward therefrom, and the lip portion extending toward the exterior surface, the mounting hook positioned on the horizontal member; and, a pin inserted through the aperture in the upper portion of the mounting hook to limit horizontal travel of the mounting hook relative to the horizontal member, wherein the container is sized so that at least a portion of the exterior surface rests against an engaging surface of the personnel lift to support the container in a substantially vertical orientation when the mounting hook is positioned on the horizontal member.

15. The combination of claim 14, wherein the horizontal member is offset horizontally from the engaging surface and wherein the mounting hook has a fixed width sufficient to permit the container to be substantially vertically oriented.

16. The combination of claim 14, wherein the upper portion of the mounting hook further comprises a plurality of apertures so the pin can be selectively inserted to adjust the position of the pin relative to the horizontal member.

17. The combination of claim 14, further comprising a cord having a first end and a second end, the first end connected to the pin and the second end connected to the container.

18. The combination of claim 17, wherein the cord is wrapped around at least a portion of the horizontal member when the pin is inserted into the aperture so as to further secure the mounting hook relative to the horizontal member.

19. The combination of claim 14, further comprising a pin retainer attached to the pin to limit the vertical travel of the mounting hook relative to the horizontal member.

20. The combination of claim 19, wherein the pin is threaded.

21. The combination of claim 20, wherein the pin retainer is a threaded nut.

22. The combination of claim 19, wherein the pin retainer expands after the pin is inserted into the aperture.

23. The combination of claim 14, wherein the container further comprises a pair of tubular members extending from the closed lower end to the horizontal panel to define a pair of passages extending through the closed lower end, the storage portion, and the horizontal panel.

24. The combination of claim 14, wherein two opposing sides of the container are open to the storage portion.

25. The combination of claim 14, further comprising a second box-like container attached to the container.

26. The combination of claim 25, wherein the second container further comprises at least two coplanar nipples adapted to selectively receive accessories, the nipples being offset horizontally and vertically.

27. The combination of claim 14, wherein the personnel lift further comprises a plurality of horizontal members and a plurality of vertical members cooperating to substantially define at least a portion of the vertices of a box shaped work area having a bottom surface defined by the work platform, the box shaped work area extending upward from the work platform.

* * * * *